US009144892B2

(12) United States Patent
Cumma

(10) Patent No.: US 9,144,892 B2
(45) Date of Patent: Sep. 29, 2015

(54) ROTATABLY ENGAGED SOCKET SET

(71) Applicant: Anthony B. Cumma, Brooklyn, NY (US)

(72) Inventor: Anthony B. Cumma, Brooklyn, NY (US)

( * ) Notice: Subject to any disclaimer, the term of this patent is extended or adjusted under 35 U.S.C. 154(b) by 289 days.

(21) Appl. No.: 13/889,039

(22) Filed: May 7, 2013

(65) Prior Publication Data

US 2014/0331824 A1 Nov. 13, 2014

(51) Int. Cl.

| | |
|---|---|
| ***B25F 1/04*** | (2006.01) |
| ***B25B 13/06*** | (2006.01) |
| ***B25B 13/00*** | (2006.01) |
| ***B25B 13/56*** | (2006.01) |

(52) U.S. Cl.

CPC ..... *B25B 13/06* (2013.01); *B25B 13/005* (2013.01); *B25B 13/56* (2013.01); *B25F 1/04* (2013.01)

(58) Field of Classification Search

CPC ..... B25B 13/005; B25B 13/06; B25B 13/28; B25B 13/56; B25B 23/0007; B25B 23/0035; B25F 1/02; B25F 1/04; B25G 1/06; B25G 1/063

USPC ..... 81/124.4, 124.5, 57.5, 124.6

See application file for complete search history.

(56) References Cited

U.S. PATENT DOCUMENTS

| | | | | | |
|---|---|---|---|---|---|
| 1,407,860 | A | * | 2/1922 | Hawkinson | 81/57.5 |
| 1,436,195 | A | * | 11/1922 | Quigley | 81/57.5 |
| 1,476,058 | A | | 12/1923 | Drahonovsky | |
| 1,571,148 | A | | 1/1926 | Sisolak | |
| 1,673,761 | A | * | 6/1928 | Dowd | 81/57.5 |
| 2,834,237 | A | * | 5/1958 | Renoux | 81/57.5 |
| 4,505,171 | A | | 3/1985 | Chang | |
| D639,625 | S | | 6/2011 | Chang | |
| 2011/0197718 | A1 | | 8/2011 | Meholovitch | |
| 2011/0232424 | A1 | | 9/2011 | Chang | |
| 2012/0240731 | A1 | * | 9/2012 | Chu | 81/57.5 |

* cited by examiner

*Primary Examiner* — Hadi Shakeri

(57) ABSTRACT

The rotatably engaged socket set includes a plurality of differently sized sockets that are collectively connected at a center such that the differently sized sockets each extend radially from the center. The differently sized sockets are able to rotate through armatures forming the U-shaped member in order to select a desired socket for use. The U-shaped member includes a square drive at a distal end of the U-shaped member such that the rotatably engaged socket set is configured to attach to an existing socket drive, which may involve an impact wrench or pry bar or ratchet. Upon attachment of the existing socket drive to the square drive of the U-shaped member, a selected socket is longitudinally aligned and configured for use in tightening or loosening a nut or head of a bolt.

6 Claims, 6 Drawing Sheets

ROTATABLY ENGAGED SOCKET SET

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of hand tools, more specifically, a socket set that are collectively attached together and are rotatable engaged.

B. Discussion of the Prior Art

As will be discussed immediately below, no prior art discloses a plurality of differently sized sockets that are collectively connected at a center such that the differently sized sockets each extend radially from the center; wherein the center includes a thru hole into which a pivoting pin attaches the center to a U-shaped member; wherein the differently sized sockets are able to rotate through armatures forming the U-shaped member; wherein the U-shaped member includes a square drive at a distal end of the U-shaped member such that the rotatably engaged socket set is configured to attach to an existing socket drive, which may involve an impact wrench or pry bar or ratchet; upon attachment of the existing socket drive to the square drive of the U-shaped member, a selected socket is longitudinally aligned and configured for use in tightening or loosening a nut or head of a bolt; wherein the differently sized sockets may form a cross shape or other shape attributed with the number of differently sized sockets included; wherein all sockets are able to rotate through the armatures in order to enable selection of any of the sockets when in use.

The Chang Patent Application Publication (U.S. Pub. No. 2011/0232424) discloses a wrench for different sized nuts having a swiveling support member. However, the swiveling support member is affixed to a handle, and is unable to be configured for use with any number of types of socket drivers.

The Meholovitch Patent Application Publication (U.S. Pub. No. 2011/0197718) discloses a wrench drive member that includes a body that is rotatably coupled to the handle and at least one socket coupled to the body. Again, the wrench drive member is affixed to a handle, and is unable to be configured for use with any number of types of socket drivers.

The Chang Patent (U.S. Pat. No. 4,505,171) discloses a cross wrench having a folding central attachment. However, the central member is not a U-shaped member that enables armatures to attach to a center of a plurality of differently sized sockets.

The Sisolak Patent (U.S. Pat. No. 1,571,148) discloses a wrench having multiple sized sockets that rotate about a central axis. Again, the wrench is affixed to a handle, and is unable to be configured for use with any number of types of socket drivers.

The Drahonovsky Patent (U.S. Pat. No. 1,476,058) discloses a wrench having a plurality of sockets of various sizes carried by a central brace member. However, the central brace member is unable to be configured for use with any number of types of socket drivers.

The Chang Patent (U.S. Pat. No. Des. 639,625) illustrates an ornamental design for a foldable wrench, which is not depicted to operate with an existing socket driver.

While the above-described devices fulfill their respective and particular objects and requirements, they do not describe a plurality of differently sized sockets that are collectively connected at a center such that the differently sized sockets each extend radially from the center; wherein the center includes a thru hole into which a pivoting pin attaches the center to a U-shaped member; wherein the differently sized sockets are able to rotate through armatures forming the U-shaped member; wherein the U-shaped member includes a square drive at a distal end of the U-shaped member such that the rotatably engaged socket set is configured to attach to an existing socket drive, which may involve an impact wrench or pry bar or ratchet; upon attachment of the existing socket drive to the square drive of the U-shaped member, a selected socket is longitudinally aligned and configured for use in tightening or loosening a nut or head of a bolt; wherein the differently sized sockets may form a cross shape or other shape attributed with the number of differently sized sockets included; wherein all sockets are able to rotate through the armatures in order to enable selection of any of the sockets when in use. In this regard, the rotatably engaged socket set departs from the conventional concepts and designs of the prior art.

SUMMARY OF THE INVENTION

The rotatably engaged socket set includes a plurality of differently sized sockets that are collectively connected at a center such that the differently sized sockets each extend radially from the center. The center includes a thru hole into which a pivoting pin attaches the center to a U-shaped member. The differently sized sockets are able to rotate through armatures forming the U-shaped member in order to select a desired socket for use. The U-shaped member includes a square drive at a distal end of the U-shaped member such that the rotatably engaged socket set is configured to attach to an existing socket drive, which may involve an impact wrench or pry bar or ratchet. Upon attachment of the existing socket drive to the square drive of the U-shaped member, a selected socket is longitudinally aligned and configured for use in tightening or loosening a nut or head of a bolt. The differently sized sockets may form a cross shape or other shape attributed with the number of differently sized sockets included.

It is an object of the invention to provide a set of differently sized sockets that are collectively attached at a center, which attaches to a U-shaped member via a pivot pin such that any of the sockets may be longitudinally aligned for use with respect to the U-shaped member.

A further object of the invention is to configure use of the invention with any type of socket driver.

A further object of the invention is to provide a square drive that is located at a distal end of the U-shaped member, and opposite of the armatures of the U-shaped member.

A further object of the invention is to provide a socket set that rotates about a center so that a selected socket is aligned linearly with respect to the square drive.

These together with additional objects, features and advantages of the rotatably engaged socket set will be readily apparent to those of ordinary skill in the art upon reading the following detailed description of presently preferred, but nonetheless illustrative, embodiments of the rotatably engaged socket set when taken in conjunction with the accompanying drawings.

In this respect, before explaining the current embodiments of the rotatably engaged socket set in detail, it is to be understood that the rotatably engaged socket set is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the rotatably engaged socket set.

It is therefore important that the claims be regarded as including such equivalent construction insofar as they do not depart from the spirit and scope of the rotatably engaged socket set. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
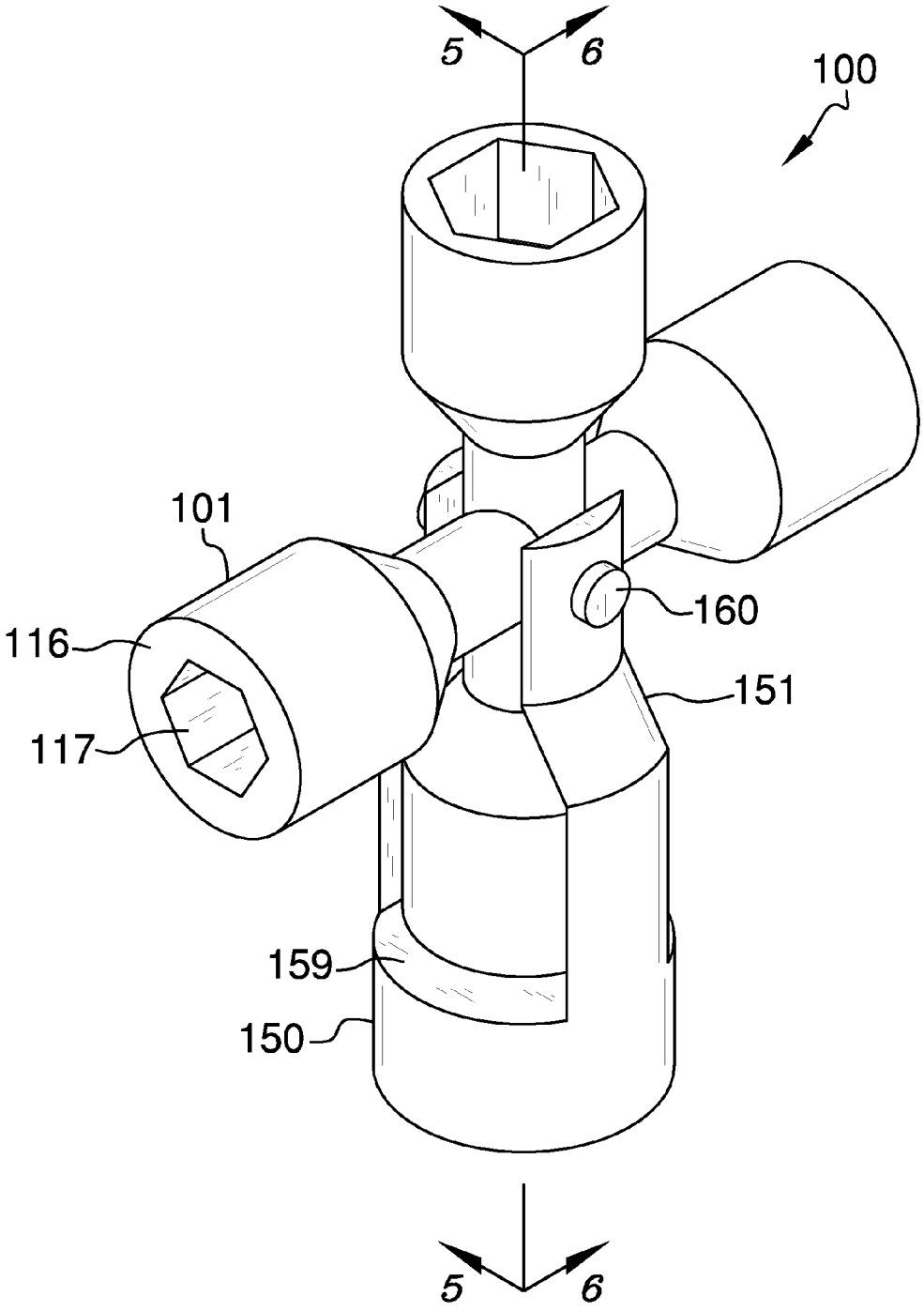
FIG. 1 illustrates a top, perspective view of the rotatably engaged socket set by itself.
Figure 2:
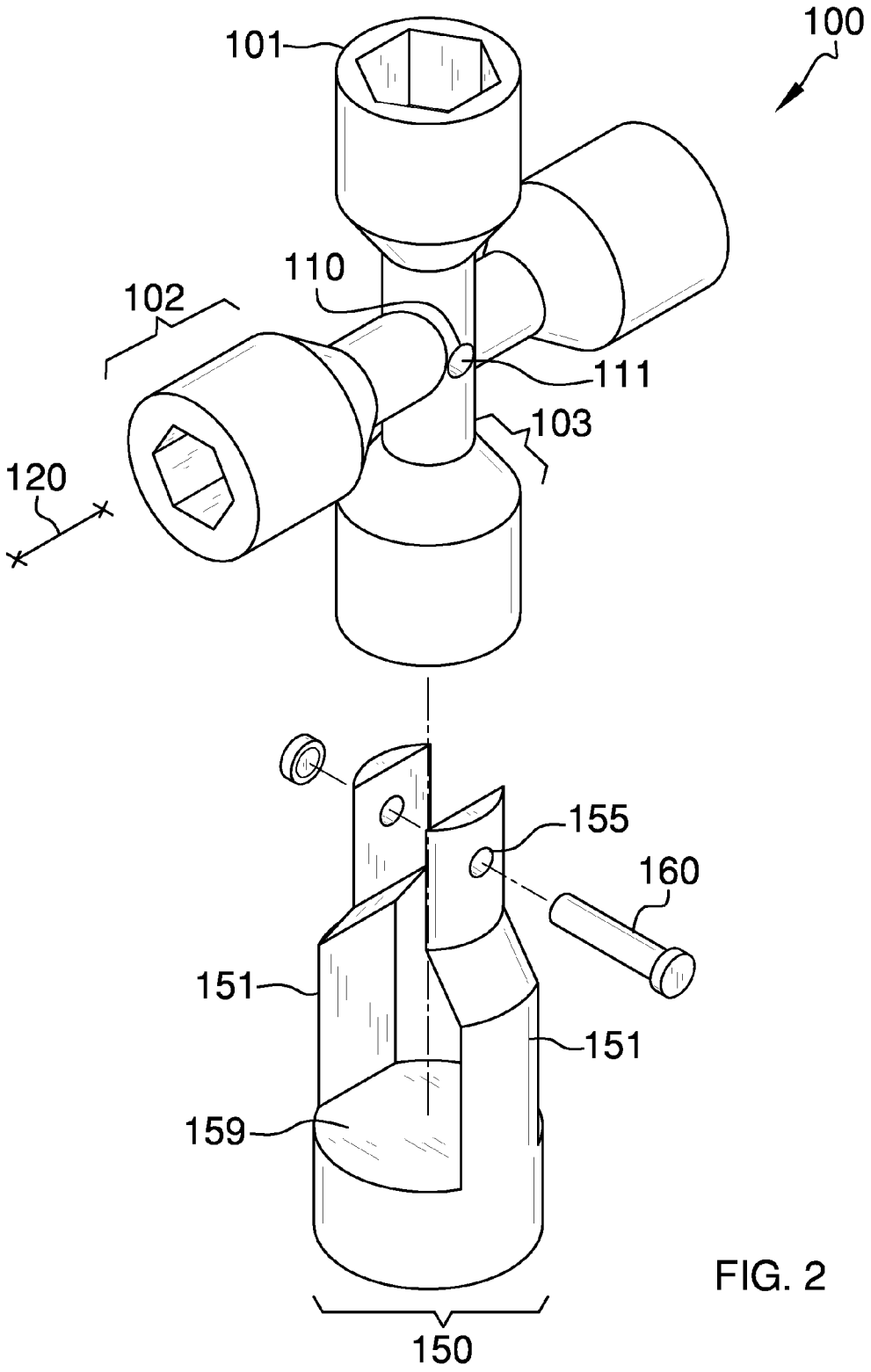
FIG. 2 illustrates an exploded, perspective view of all componentry associated with the rotatably engaged socket set.
Figure 3:
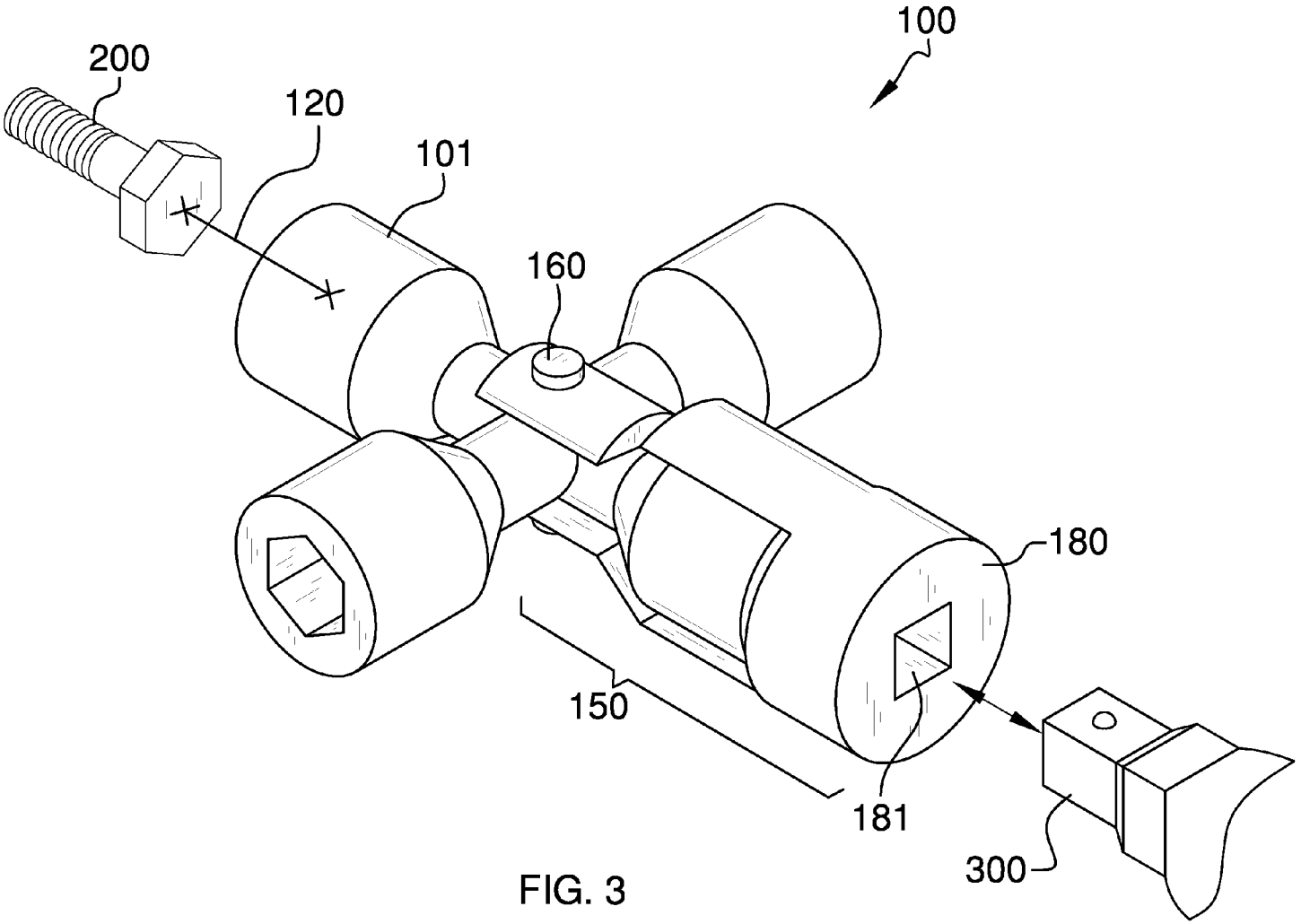
FIG. 3 illustrates a side, perspective view of the rotatably engaged socket set.
Figure 4:
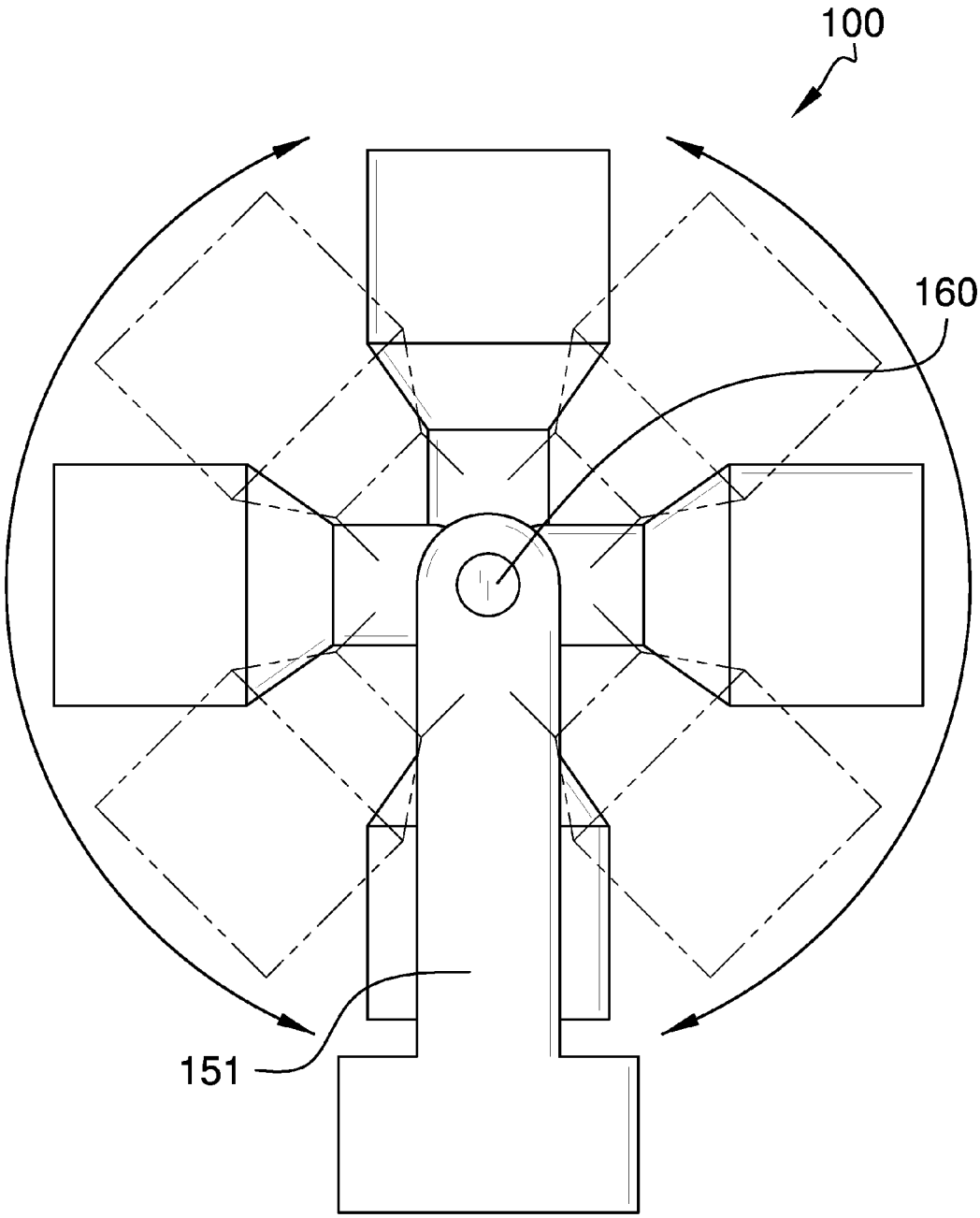
FIG. 4 illustrates a side view of the differently sized sockets rotating with respect to the U-shaped member.
Figure 5:
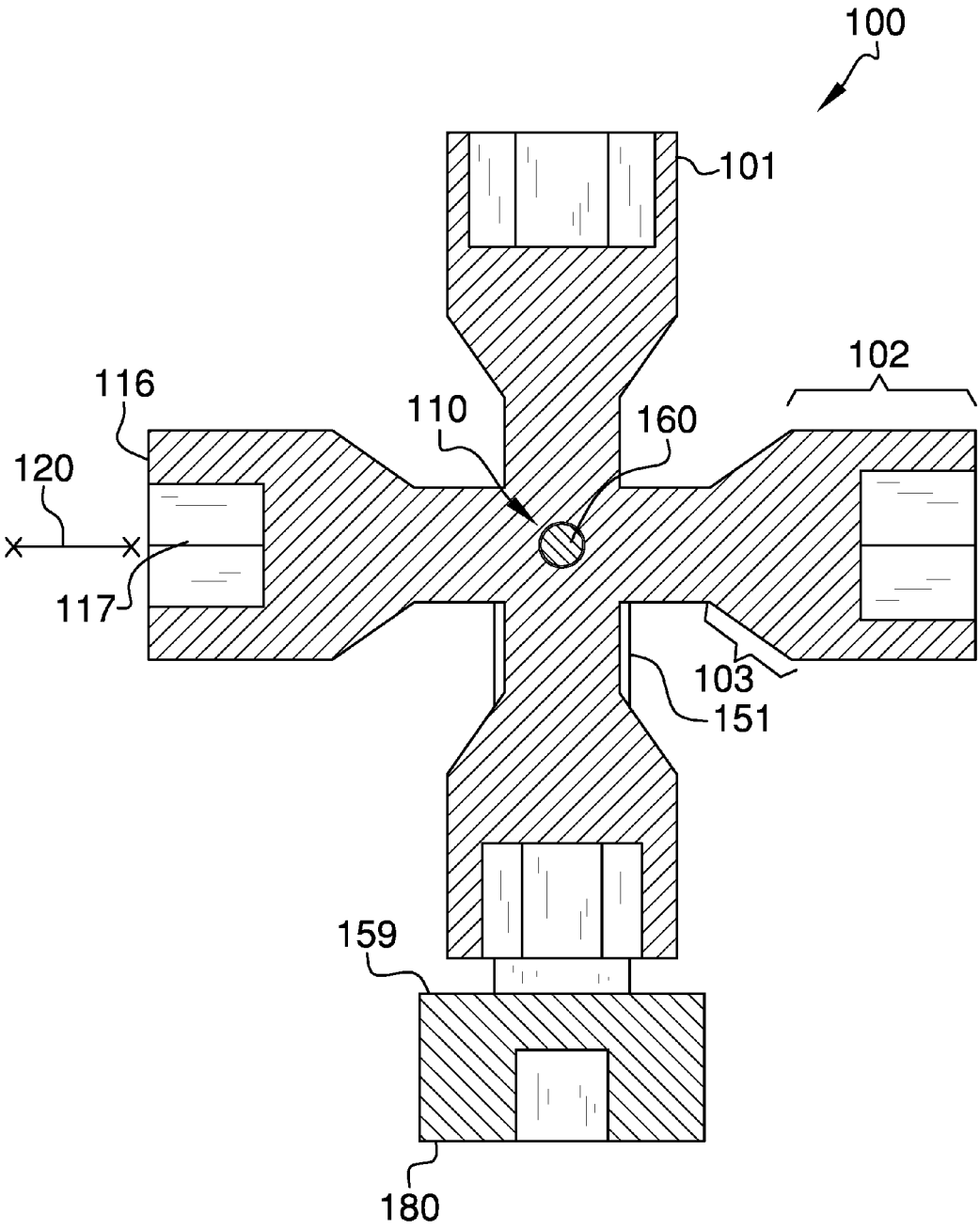
FIG. 5 illustrates a cross-sectional view along line 5-5 in FIG. 1.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-6. A rotatably engaged socket set 100 (hereinafter invention) includes a plurality of differently sized sockets 101 each further defined with a socket body 102 from which a socket neck 103 extends.

The socket necks 103 of all of the sockets 101 join to form a center 110, which includes a thru hole 111 that is perpendicularly oriented with respect to a socket axis 120. The socket axis 120 is the axis of rotational movement associated with the tightening or loosening of a nut or bolt head 200. It shall be further noted that the term nut or bolt head 200 implies a hexagonally-shaped body that is often associated with different fasteners.

It shall be noted that the sockets 101, socket bodies 102, the socket necks 103, and the center 110 may all be formed of a single piece. Moreover, the sockets 101 may form a particular overall shape, which is contingent upon the actual number of sockets 101. Moreover, the invention 100 is depicted with a total of four sockets 101 that are offset from one another at 90 degrees, which results in a plus-shaped object.

Figure 6:
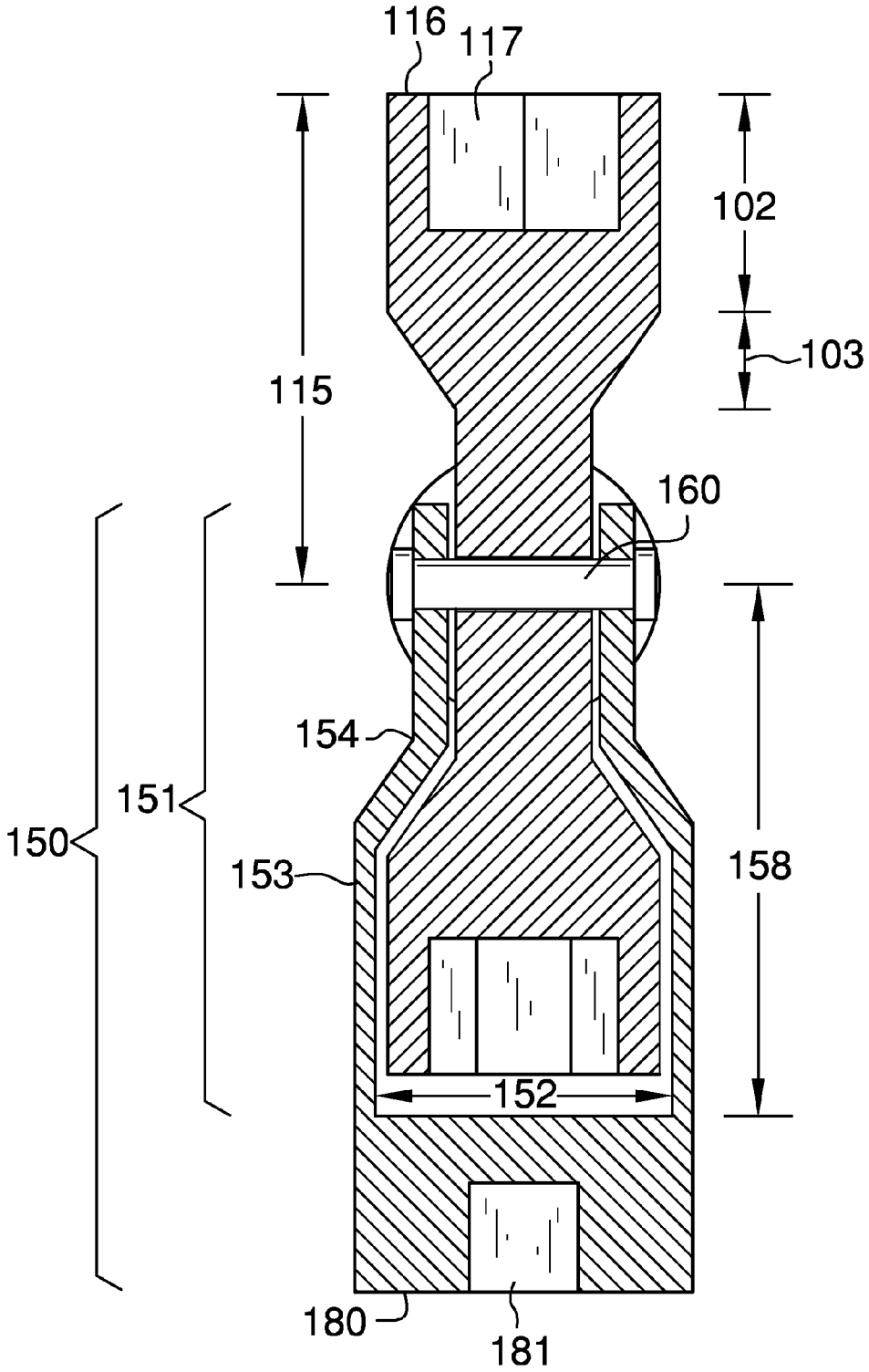
FIG. 6 illustrates a second cross-sectional view along line 6-6 in FIG. 1.

The invention 100 includes a U-shaped member 150 that is further defined with armatures 151 that are generally parallel with one another. The armatures 151 mirror in shape and are separated from one another via an armature distance 152. Referring to FIG. 6, the armatures 151 each have a first bend 153 as well as a second bend 154, which corresponds with the overall external shape of the socket bodies 102. Moreover, the armatures 151 each include a pivot hole 155 at a first distal end of the U-shaped member 150. The pivot holes 155 enable the armatures 151 to securely attach the center 110 via a pivot pin 160 that passes across the thru hole 111. The pivot pin 160 enables the socket bodies 102 to rotate in and out of the space formed between the armatures 150. Moreover, the pivot pin 160 enables a full 360 degrees of rotational movement of the sockets 101. Moreover, the sockets 101 are able to rotate either clockwise or counterclockwise with respect to the armatures 151.

It shall be further noted that an armature length 158 is defined as a distance from either of the pivot holes 155 to a planar surface 159 that is located on the U-shaped member 150. Moreover, the armature length 158 shall be equal to or greater than a socket length 115. The socket length 115 is defined as a distance from the thru hole 111 to a distal socket surface 116. It shall be noted that the distal socket surface 116 contains the socket opening 117.

The U-shaped member 150 includes a second planar surface 180 that is located on an end of the U-shaped member 150, which is opposite the armatures 150. The second planar surface 180 includes a square drive 181 integrated therein, which is configured for use with an existing socket driver 300. As previously noted, the socket driver 300 may involve a multitude of different types comprising an pneumatic impact wrench, ratchet driver, or a pry bar.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A rotatably engaged socket set comprising:

a plurality of differently sized sockets that are rigidly connected together at a center and to which a U-shaped member is attached via a pivot pin such that each of the sockets are able to rotate through the U-shaped member;

wherein a square drive is provided on the U-shaped member, and the square drive is configured for attachment with a socket driver;

wherein a selected socket is linearly aligned with respect to the socket driver;

wherein the plurality of differently sized sockets are each further defined with a socket body from which a socket neck extends;

wherein the socket necks of all of the sockets join to form the center, which includes a thru hole that is perpendicularly oriented with respect to a socket axis;

wherein the socket axis is the axis of rotational movement associated with the tightening or loosening of a hexagonally-shaped body;

wherein the sockets, socket bodies, the socket necks, and the center may all be formed of a single piece;

wherein the U-shaped member is further defined with armatures that are generally parallel with one another and extend form a first planar surface defined by a base of the U-shaped member, the base further defining a second planar surface that is located on an end of the U-shaped member, which is opposite the armatures, wherein the second planar surface includes the square drive integrated therein;

wherein the armatures mirror in shape and are separated from one another via an armature distance; wherein the armatures each have a first bend as well as a second bend, which corresponds with the overall external shape of the socket bodies; wherein the armatures each include a pivot hole at a first distal end of the U-shaped member; wherein the pivot holes enable the armatures to securely attach the center via the pivot pin that passes across the thru hole; wherein the pivot pin enables the socket bodies to rotate in and out of the space formed between the armatures; wherein the pivot pin enables a full 360 degrees of rotational movement of the sockets; wherein the sockets are able to rotate either clockwise or counterclockwise with respect to the armatures.

2. The rotatably engaged socket set as described in claim 1 wherein an armature length is defined as a distance from either of the pivot holes to the first planar surface; wherein the armature length shall be equal to or greater than a socket length.

3. The rotatably engaged socket set as described in claim 2 wherein the socket length is defined as a distance from the thru hole to a distal socket surface; wherein the distal socket surface contains a socket opening.

4. A rotatably engaged socket set comprising:

a plurality of differently sized sockets that are rigidly connected together at a center and to which a U-shaped member is attached via a pivot pin such that each of the sockets are able to rotate through the U-shaped member;

wherein a square drive is provided on the U-shaped member, and the square drive is configured for attachment with a socket driver;

wherein a selected socket is linearly aligned with respect to the socket driver;

wherein the plurality of differently sized sockets are each further defined with a socket body from which a socket neck extends;

wherein the socket necks of all of the sockets join to form the center, which includes a thru hole that is perpendicularly oriented with respect to a socket axis;

wherein the socket axis is the axis of rotational movement associated with the tightening or loosening of a hexagonally-shaped body;

wherein the sockets, socket bodies, the socket necks, and the center may all be formed of a single piece;

wherein the U-shaped member is further defined with armatures that are generally parallel with one another and extend form a first planar surface defined by a base of the U-shaped member, the base further defining a second planar surface that is located on an end of the U-shaped member, which is opposite the armatures, wherein the second planar surface includes the square drive integrated therein;

wherein the armatures mirror in shape and are separated from one another via an armature distance;

wherein the armatures each have a first bend as well as a second bend, which corresponds with the overall external shape of the socket bodies;

wherein the armatures each include a pivot hole at a first distal end of the U-shaped member; wherein the pivot holes enable the armatures to securely attach the center via the pivot pin that passes across the thru hole; wherein the pivot pin enables the socket bodies to rotate in and out of the space formed between the armatures; wherein the pivot pin enables a full 360 degrees of rotational movement of the sockets; wherein the sockets are able to rotate either clockwise or counterclockwise with respect to the armatures.

5. The rotatably engaged socket set as described in claim 4 wherein an armature length is defined as a distance from either of the pivot holes to the planar surface; wherein the armature length shall be equal to or greater than a socket length.

6. The rotatably engaged socket set as described in claim 5 wherein the socket length is defined as a distance from the thru hole to a distal socket surface; wherein the distal socket surface contains a socket opening.

* * * * *